United States Patent [19]

Bohrn

[11] 3,945,791

[45] Mar. 23, 1976

[54] IN-REGISTER PRINTED AND EMBOSSED CARPET

[75] Inventor: Walter J. Bohrn, Lancaster, Pa.

[73] Assignee: Armstrong Cork Company, Lancaster, Pa.

[22] Filed: Mar. 29, 1974

[21] Appl. No.: 456,016

Related U.S. Application Data

[63] Continuation-in-part of Ser. No. 51,210, June 30, 1970, abandoned, and a continuation-in-part of Ser. No. 157,889, June 29, 1971, abandoned.

[52] U.S. Cl. ..... 8/17; 8/14; 8/62; 8/114.5; 8/149

[51] Int. Cl.[2] ..... D06P 5/00

[58] Field of Search ..... 8/14, 17, 62, 149

[56] References Cited

UNITED STATES PATENTS

| | | | |
|---|---|---|---|
| 2,110,866 | 3/1938 | Castles | 8/115 |
| 2,317,359 | 4/1943 | Cassel | 8/62 |
| 2,984,540 | 5/1961 | Tillett et al. | 8/62 |
| 3,031,253 | 4/1962 | Gilbert et al. | 8/177 |
| 3,170,757 | 2/1965 | Gift et al. | 8/14 |
| 3,282,717 | 11/1966 | Kelly | 8/62 |
| 3,434,189 | 3/1969 | Buck et al. | 8/14 |
| 3,434,793 | 3/1969 | Pratt | 8/62 |
| 3,505,000 | 4/1970 | Shinmura et al. | 8/115 |
| 3,775,054 | 11/1973 | Devinney | 8/14 |

FOREIGN PATENTS OR APPLICATIONS

| | | | |
|---|---|---|---|
| 544,820 | 4/1942 | United Kingdom | 8/114.5 |

*Primary Examiner*—Ronald W. Griffin

[57] ABSTRACT

A carpet material is printed with a decorative pattern. The ink formulation used for printing will for some portions of the pattern contain a solvent for the fiber of the carpet. The carpet is passed through a series of printing stages all prior to the time the carpet is steamed. After all printing is done, the carpet is steamed once. This causes the fibers which have been printed with a solvent to shrink and/or dissolve to produce an embossed effect. The other printed areas will have the dye in the ink set in the carpet. The carpet is then washed and dried. There is produced a carpet having an embossed pattern effect with a natural fibrous appearance in the embossed areas.

3 Claims, 1 Drawing Figure

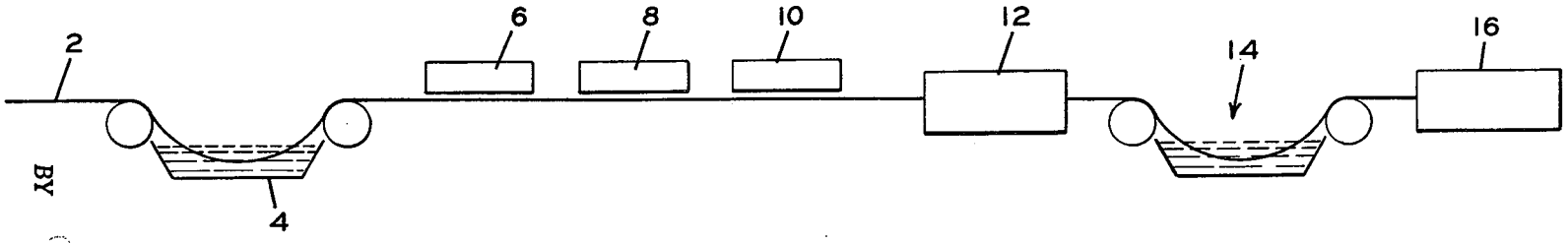
INVENTOR
WALTER J. BOHRN
BY Clifford D. Price
ATTORNEY

IN-REGISTER PRINTED AND EMBOSSED CARPET

CROSS-REFERENCE TO RELATED APPLICATIONS

This application is a continuation-in-part of copending application Ser. No. 51,210, filed June 30, 1970, by Walter J. Bohrn, and entitled "Steam-Etched Solvent Embossed Carpet", now abandoned, and a continuation-in-part of copending application Ser. No. 157,889, filed June 29, 1971, by Walter J. Bohrn, and entitled "In-Register Printed and Embossed Carpet", now abandoned.

BACKGROUND OF THE INVENTION

1. Field of the Invention

This invention is directed to a process for making a printed and embossed carpet and particularly to a process for making a carpet having the design and embossing in register.

2. Description of the Prior Art

The above-mentioned patent applications fully disclose the status of the prior art relative to the making of a carpet product having an embossed configuration. In all the prior art processes, the embossed effect was secured with or without a coloring in the embossed region. Normally, all embossed carpet is of one color, and there is no attempt made to provide a two-color effect. The first above-mentioned copending application was one of the first steps towards the coloring of the embossed areas. It has been only recently that embossed effects have been provided on carpeting.

It is noted that in the publications, for example, the book "The Principles and Practice of Textile Printing" by Edmund Knecht, 4th Edition, 1952, publisher Charles Griffen & Company Limited, London, page 31, there is the clear teaching that when one wet color is superimposed over another wet color or when two wet colors are close to each other so that one wet color will run into the other wet color, a drying step after each wet color is carried out. Therefore, it would appear that the art clearly suggests a steaming step between each ink application step for the purpose of setting the dye of the ink.

SUMMARY OF THE INVENTION

The process herein involves the printing of a plurality of pattern components in register on a carpet. The carpet may pass through a dye bath to provide it with background color. The carpet then passes through a series of printing stations which apply a pattern to the carpet due to dyes in the printing inks. At some of the printing stations, the inks which provide the pattern components to the carpet also include a solvent which will cause shrinkage of the carpet fibers to give an embossed effect to the carpet. After the carpet has been totally printed with all of its pattern components, it is passed to a steam chamber where the steaming effects the embossing of the carpet and the setting of the dyes. Finally, the carpet material is washed and then dried to remove the wash water. There is now provided a carpet with a pattern having embossed design areas and non-embossed design areas in registration. All operations were performed along a continuous line in a single pass operation through the printer with only the need for a single steaming operation. Consequently, the above process provides a simplicity of operation and a reduction in cost along with a guarantee of registry in the pattern.

BRIEF DESCRIPTION OF THE DRAWING

The FIGURE of the drawing is a representation of the process utilized herein.

DESCRIPTION OF THE PREFERRED EMBODIMENT

Referring to the drawing, the process herein involves the printing of carpet or any type of pile fabric with dyes and solvents for the fibers. The carpet material 2 may initially be fed through a conventional dye tank 4 and dip dyed to color it. The dye in the tank would be any conventional dye capable of dyeing the fabric of the carpet and would provide the carpet with background color for the subsequently printed pattern components. While the dyed carpet material is still in its wet state, it is fed on to subsequent printing stations. The operation of the feeding is such that the carpet will be fed from the first dye bath by the printing stations to the steaming station. There will be a substantially continuous feeding of the carpet through the printing stations and to the steaming chamber. By "substantially continuous" is meant a process which is carried out in a matter of minutes versus one which would be carried out in a matter of hours. The carpet component which is to be handled is a flexible, stretchable material which normally has pile fabric tufted into a flexible, stretchable backing. By the terms " flexible and stretchable" is meant a carpet material which will be flexible and will stretch during handling. This is to be contrasted against the term "rigid" which normally denotes a non-flexible, non-stretchable condition. There is no known carpet product being made now which could be called "rigid". Most carpet products being made are flexible and stretchable and such a property is necessary in the carpet to enable the carpet to be laid.

A plurality of subsequent printing stages may be provided to place the pattern configuration on the carpet. The number of printing stations involved will depend upon the complexity of the pattern and the degree of embossing. For illustration purposes, three printing stations have been shown in the drawing. At the first printing station 6, the carpet would be printed with a decorative pattern component using a conventional printing ink containing a carpet dye. The carpet would then be passed on to a second printing station 8 which would put on another portion of the pattern. Finally, the carpet would pass on to station 10 which would provide the third phase of the carpet pattern. Here, the printing ink may contain a solvent plus a dye(s) for the fiber of the carpet or just simply a solvent for the carpet fibers. It is obvious that a number of solvent printing steps may be used. The sequence of printing the dye and solvent may be varied.

Normally, the printing stations would be flat bed screen printers such as are conventional in the art. Rotary screen printers or other suitable devices may be used. The carpet would move with an intermittent operation being indexed from one station to the next and would be inherently in registry. Machines capable of this work are similar to those set forth in the Zimmer U.S. Pat. No. 3,495,285. After all the printing and dyeing operations are performed, the carpet then passes to a steam chamber 12 in which steam in a temperature range of 212° to 220°F. is applied to the carpet. Under the effects of the steam, the dye will develop or set on the fibers. In addition, and of particular importance, is that under the effects of the steam, the fibers in the area treated with the solvent will shrink and to a degree dissolve to produce an embossed effect in the printed area. The carpet then passes on to a conventional wash tank 14 through which the carpet passes to remove the residual printing ink and any other residual chemicals which may remain in the carpet. The carpet then passes on to conventional drying structure 16 which evaporates the wash water from the carpet in the usual manner. The carpet coming out of the dryer has a good hand, and the appearance obtained in the embossed area is that of a fibrous material. The loft of the carpet is maintained, the embossed areas are particularly pleasing in appearance, and the pattern components are in complete register.

In one typical embodiment of the invention, an acrylic fiber carpet material is fed through a dye bath 4 containing the following carpet dye:

Basic Yellow 11

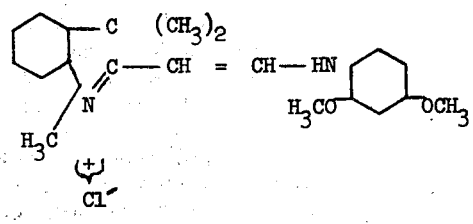

This provides a background coloring. The yellow dye is water soluble and is mixed at the rate of 1 part dye to 99 parts water. Viscosity of this solution is between 15–200 centipoises. The wet carpet then passes on to the first printing station 6 wherein the printing ink contains the following materials by weight: 98% water, 1½% modified locust bean gum thickener and ½% water-soluble dye — Basic Blue 25

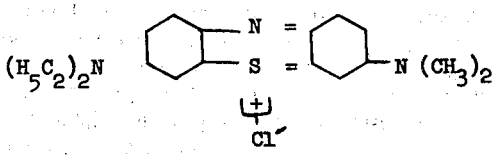

This dye solution is at a viscosity of about 5000–5500 centipoises and provides a printed pattern to the background colored carpet. The wet carpet then passes on to the second pattern printing station which contains the same basic materials as the first printing station except that the dye was Basic Orange 21.

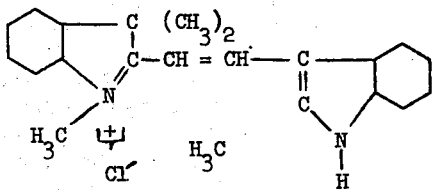

Specifically the dye solution contains the following materials by weight: 98½% water, 1% Cellosize QP 100M thickener (Union Carbide brand of hydroxyethyl cellulose) and ½% dye at a solution viscosity of 5000–5500 centipoises.

Finally, the wet carpet passes on to station 10 wherein the printing ink is basically a thickened aqueous solution of ethylene carbonate as set forth in the first above-mentioned copending application. Specifically the solvent containing solution contains the following material by percentage by weight: 44% water, 55% ethylene carbonate and 1% Cellosize QP 100M thickener at a solution viscosity of 5000–5500 centipoises. This solution provides a third printed pattern on the background colored carpet. Obviously, as indicated in the above-mentioned copending application, the solvent will change depending upon the fiber type used in the carpet being treated. Also, the dyes will change, depending upon the color desired, the type of fibers used and the availability of dyes. No invention lies in this case in the selection of the particular dyes and solvents. Of primary importance herein is the fact that the total treatment of the carpet to provide it with a pattern is provided in a series of sequential steps which are readily controlled in register prior to the time that the carpet passes to the steam chamber to cause the embossing and to set the dyes. The sequence of operations is carried out in a substantially continuous sequence of steps without any appreciable time delay between the series of steps. In addition to the fact that a prolonged wait between the series of steps may result in the bleeding of the dyes into each other, there is also a problem that the water may evaporate from the aqueous solution of solvent, thus increasing the solvent concentration in position and causing deleterious destruction of the carpet fibers.

Basically, the control of bleeding of the differently colored dyes into each other is carried out through proper attention to the viscosity of the printing inks and the rheology of the dyes. The thickeners in the ink are important in controlling the viscosity of the inks. The thickeners let the ink function so that under force (shear), the ink will flow into the carpet, but with the removal of force (shear), there is no flow of the ink laterally (bleeding). Consequently, the rheology of the ink may be described as being a condition of the ink that has the ink at low viscosity under shear, but at high viscosity when without shear. Naturally, the viscosity of the ink must be temperature insensitive or else the inks would flow during steaming.

Viscosity is generally kept in the range of 3500 to 6000 centipoises. These viscosity readings would be based on readings taken on a Brookfield Model RVF Viscometer using a No. 4 spindle run at 20 rpm. The viscosity secured is simply dependent on the amount of thickener added and this must be based generally on a trial and error basis with each different ink used.

One final point is of some concern. That is, the inks cannot be left indefinitely on the carpet without setting them with the steaming. The steaming should be carried out within about ten minutes of the printing of the inks. Prolonged periods of time beyond this will result in some bleeding of the inks into each other.

As used herein, the term "pattern" means a composite of embossed and non-embossed design elements.

The non-embossed design elements are provided with a decorative coloring. The embossed areas may or may not have added coloring. As used herein, the term "register" means a composite of embossed and non-embossed design elements wherein the elements are either overlying each other or are in an abutting relationship. This may mean that there is a dye design placed overtop of a background dye coloring or a solvent design printed on a background dye coloring or two adjacent dye designs of different colors placed in abutting relationship or other similar variations of the above. "Register" is not meant to cover a large number of very detached design elements which are spaced apart a certain distance and repeated.

What is claimed is:

1. In a process for producing a carpet having a pattern printed thereon, said carpet being flexible and stretchable during handling, the pattern on the carpet having embossed design areas and non-embossed design areas in register, consisting of the steps of:

a. passing the carpet substantially continuously through a series of printing, steaming, washing and drying steps, b. printing the carpet with at least one pattern component using only a dye to provide the pattern component, c. moving the carpet to a second printing station wherein the previously printed pattern component will be in register with and abutting with the second pattern component to be printed, d. printing the second pattern component in register and abutting with the first pattern component and using a printing ink containing a solvent for the carpet fibers, said solvent will cause the carpet fibers to shrink upon a subsequential steaming operation;

the improvement comprising:

1. controlling the viscosity and rheology of the printing inks to prevent bleeding of the different printing inks into each other to destroy the sharpness of the patterns printed, the rheology of the printing ink is such that it flows into the carpet when under shear, but has no flow laterally of the carpet when not under shear, 2. then within approximately 10 minutes of the last printing step, applying only then steam to the carpet to shrink the fibers printed and affected by the solvent to produce an embossed effect in the printed areas and to set the dyes in the carpet, e. washing the carpet, and then f. drying the carpet to remove the wash water.

2. The process of claim 1 wherein the carpet is dyed to provide a background effect for the pattern components prior to the time the carpet moves to the different printing stages for printing the pattern components thereon.

3. The process of claim 2 wherein the viscosity of the ink is controlled to within a range of 3500 to 6000 centipoises.

* * * * *